United States Patent [19]

Peterson

[11] 4,221,139

[45] Sep. 9, 1980

[54] APPARATUS FOR ASSEMBLING COVERED BUTTONS

[75] Inventor: Richard J. Peterson, Paramus, N.J.

[73] Assignee: C & C Metal Products Corporation, Englewood, N.J.

[21] Appl. No.: 21,303

[22] Filed: Mar. 15, 1979

[51] Int. Cl.[3] ..... A44B 1/06

[52] U.S. Cl. ..... 79/1; 79/4

[58] Field of Search ..... 79/1, 4, 5

[56] References Cited

U.S. PATENT DOCUMENTS

| | | | |
|---|---|---|---|
| 3,550,483 | 12/1970 | Humbel | 79/5 |
| 3,863,527 | 2/1975 | Berning | 79/5 |

FOREIGN PATENT DOCUMENTS

| | | | |
|---|---|---|---|
| 811741 | 8/1951 | Fed. Rep. of Germany | 79/5 |

*Primary Examiner*—Howard N. Goldberg
*Attorney, Agent, or Firm*—Shenier & O'Connor

[57] ABSTRACT

Apparatus for assembling covered buttons in which a first die assembly including a first punch carrying a first sleeve which sequentially receives a piece of covering material and the button shell with its flange extending toward the open end of the sleeve. A second assembly including a second sleeve having a bore one end of which is formed with a first cam surface extending axially inwardly of the above. The second sleeve is spring loaded to an extended position on a supporting post having a centrally located button back fastener receiving cavity in the end thereof with a second cam surface extending inwardly from the outer edge of the end to the bottom of a recess surrounding the cavity. An annular boss at the inner edge of the recess around the cavity is elevated to allow the material and the shell flange to curl inwardly under the button back. In the retracted position of the second sleeve on the post, the second cam surface forms a continuation of the first. In operation, when the first assembly carrying the covering piece and the shell moves toward the second assembly, the first sleeve stops against the spring loaded bottom sleeve and the punch continues forcing the material down so that the material is tucked inward by the beveled or curved surface of the second sleeve. Upon continued relative movement of the assemblies, the shell flange acts on the cam surface of the second sleeve to force the sleeve to its retracted position and the shell flange is moved inwardly of the back wall under the continued action of the first post, the extent of the inward movement of the shell flange being determined by the thickness of the material of the covering piece, as well as the height of the shell and the type of back used.

4 Claims, 7 Drawing Figures

Fig 4
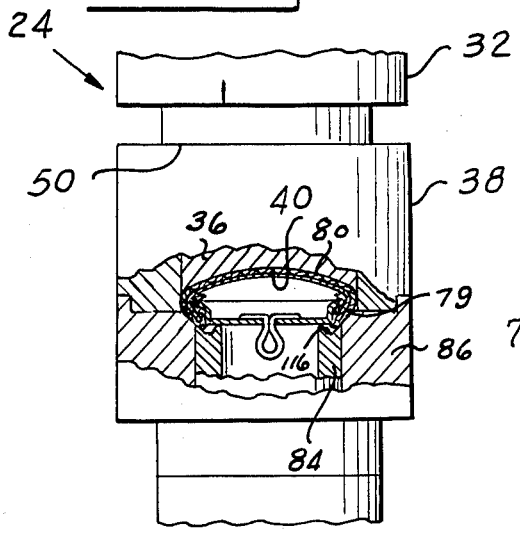
Fig 6
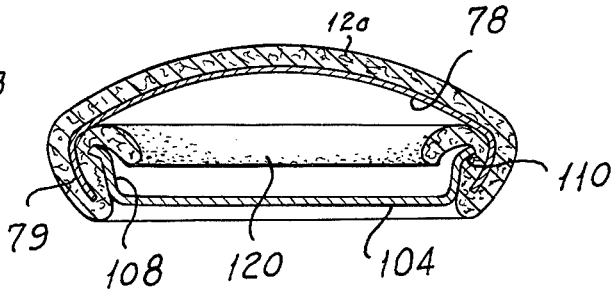
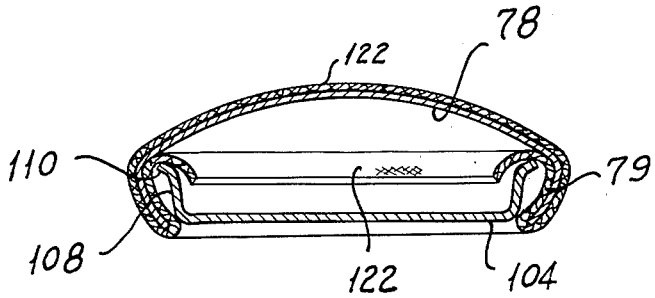
Fig 7
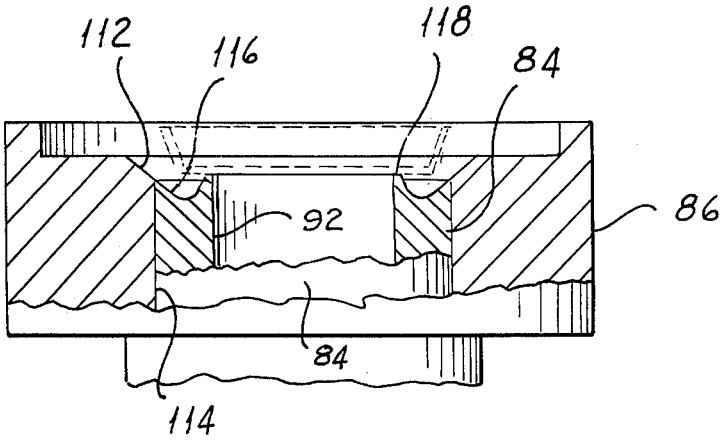
Fig 5

APPARATUS FOR ASSEMBLING COVERED BUTTONS

BACKGROUND OF THE INVENTION

There are known in the prior art covered buttons in which a piece of material is assembled over a button shell and is held in place thereover by a back with which the shell is assembled. The back may be of any type known to the art which carries any suitable fastening element such as a wire eye, or a plastic hook, or any other type of fastener which permits it to be assembled in position. There are known in the art, moreover, hand-operated, semi-automatic and completely automatic machines for assembling such buttons.

One industry in which such covered buttons find wide application is the upholstery industry, wherein the material which is used as the button covering is of the same material as is the upholstery covering which may be fabric, leather, or the like. In the upholstery industry, while a relatively large number of the same size covered buttons may be run off at the same time, only a relatively few of the buttons will require the same covering material at a particular time because of the wide range of cover fabric usually offered by the manufacturer. The material used in the course of assembling one run of buttons all of the same size may range from single ply thin goods, such as cotton, silk, rayon, or the like, up to medium or heavier weight materials, such for example as heavy knits, velvets, vinyls, and so forth. A third grade of material which may be used would be very heavy suede and thick leathers and backed vinyls. Dies for handling these various grades of material in the art are known as "LU" dies for light upholstery, "HU" dies for medium weight materials, "HUX" dies for heavy materials, and "HUXX" dies for extremely heavy materials. The dies may be so marked or may be color coded to differentiate between the different fabric weights. It will readily be apparent that, in the prior art, to make satisfactory covered buttons for the full range of materials, the manufacturer must stock several sets of dies for each size of button and must change dies each time the grade of material changes.

The difficulty in the prior art is that the average size manufacturer does not wish to go to the expense of having more than one set of dies and, particularly, does not wish to expend the time and energy required for changing of dies when going from one weight of material to another weight. Where the user attempts to use only one die for all of the various grades of material which are used in the course of a run of a single size button, the resultant buttons may be unsatisfactory. Either the buttons may pop apart or the force exerted in assembling the button is so great that the button back or shell, or both, are crushed in the course of the assembly operation, or otherwise faulty buttons are produced.

SUMMARY OF THE INVENTION

My invention relates to the field of covered button assemblies and, more particularly, to apparatus for assembling covered buttons.

One object of my invention is to provide an improved apparatus for assembling covered buttons which overcomes the defects of apparatus of the prior art for producing covered buttons.

Another object of my invention is to provide an improved apparatus for assembling covered buttons which accommodates a very wide range of covering material thicknesses, while at the same time satisfactorily assembling the buttons.

Still another object of my invention is to provide an improved apparatus for assembling covererd buttons which does not require changing of dies as the covering material changes in the course of a run in which buttons of the same size are being made.

Yet another object of my invention is to provide an improved apparatus for assembling covered buttons which greatly increases the worker's production rate.

A still further object of my invention is to provide an improved covered button assembling apparatus which does not require the manufacturer to have on hand as many as four or five sets of dies for assembling covered buttons of one size.

A still further object of my invention is to provide an improved apparatus for assembling covered buttons which is inexpensive for the result achieved thereby.

Yet another object of my invention is to provide an improved apparatus for assembling covered buttons which is especially adapted for use with backs, the wall of each of which is provided with an outwardly extending lip.

Other and further objects of my invention will appear from the following description.

In general my invention contemplates the provision of apparatus for assembling covered buttons in which a first die asembly including a punch carrying a sleeve sequentially receives a piece of covering material and the button shell with its flange extending toward the open end of the sleeve. A second assembly includes a second sleeve having a bore, one end of which is formed with a first cam surface extending axially inwardly of the bore. The second sleeve is biased to an extended position on a supporting post having a centrally located button back fastener receiving cavity in the end thereof with a second cam surface extending inwardly from the outer edge of the end to the bottom of a recess surrounding the cavity. An elevated annular boss at the inner edge of the recess around the cavity so supports the button back as to permit the material and shell flange to curl under the button back. In the retracted position of the second sleeve on the post the second cam surface forms a continuation of the first. In operation when the first assembly carrying the covering piece and shell moves toward the second assembly, the sleeves are retracted as the back moves into the shell, gathering the edge of the covering piece, and the shell flange is continuously moved inwardly of the back under the action of the first and second cam surfaces, the extent of inward movement of the shell flange being determined by the thickness of the material of the assembly carrying the covering piece and shell moves toward the second assembly, the sleeves are retracted as the back moves into the shell, gathering the edge of the covering piece, and the shell flange is continuously moved inwardly of the back under the action of the first and second cam surfaces, the extent of inward movement of the shell flange being determined by the thickness of the material of the covering piece, as well as by the height of the shell flange and the type of back used.

BRIEF DESCRIPTION OF THE DRAWINGS

In the accompanying drawings to which reference is made in the instant specification and in which like reference characters are used to indicate like parts in the various views:

FIG. 4 is a fragmentary elevation with parts in secon of my improved apparatus for assembling covered uttons with the two die assemblies in the fully closed ositions.

FIG. 5 is an elevation with parts broken away and /ith other parts shown in section of the lower die asembly of my improved apparatus for assembling fabric overed buttons with the lower die and sleeve in relavely retracted positions.

FIG. 6 is a sectional view of a button having a relavely heavy covering material formed on my improved pparatus for assembling covered buttons.

FIG. 7 is a sectional view of a button assembly having relatively thin covering material formed on my imroved apparatus for assembling covered buttons.

DESCRIPTION OF THE PREFERRED EMBODIMENT

Figure 1:
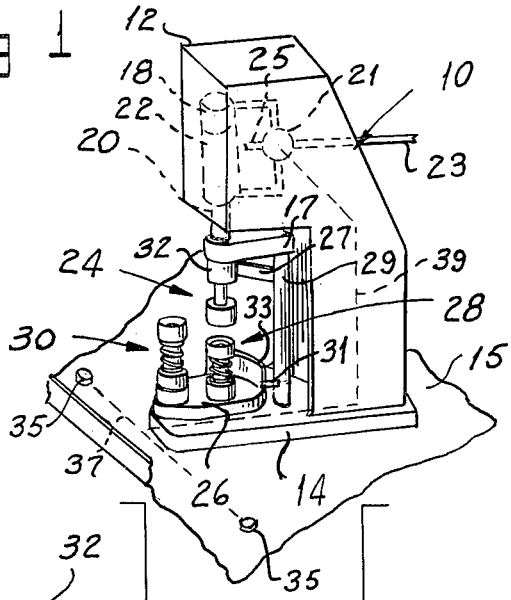
FIG. 1 is a perspective view illustrating my improved pparatus for assembling covered buttons incorporated ı one form of die assembly operating machine.

Referring now to the drawings, one form of machine ıdicated generally by the reference character 10 in /hich my improved apparatus can be incorporated ıcludes a housing 12 supported on a base 14 carried by table 15. Housing 12 supports a ram 20 for vertical eciprocating movement. Ram 20 is connected to a iston 18 mounted for movement in a cylinder 22. A our-way valve 21 normally connects the lower end of ylinder 22 to a source 23 of air under pressure while onnecting the upper end of cylinder 22 to an exhaust ne 25 to urge piston 18 and ram 20 upwardly. As indiated schematically by the broken lines 37 and 39, a pair f relatively widely spaced push buttons 35 on table 15 ıust both be operated to actuate valve 21 to a condition t which the upper end of cylinder 22 is connected to ource 23 and the lower end of the cylinder is conected to the exhaust line 25 to move ram 20 down. ince the particular type of die assembly operating ıachine with which my assembly is used is not a feature f my invention and since the details of the construction nd operation of the ram actuating structure of the ıachine 10 are well known they will not be described in urther detail.

Ram 20 carries the upper die assembly indicated genrally by the reference character 24 of my improved pparatus for assembling covered buttons to be decribed more fully hereinbelow. A swivel plate 26 suported on base 14 for movement between first and secnd positions carries the lower die assembly indicated enerally by the reference character 28 of my improved pparatus for assembling covered buttons, as well as an ssembly indicated generally by the reference character 0, which facilitates the operation of inserting the covring piece and the button shell in the upper die assemly 24 of my apparatus. As will be appreciated by those killed in the art, swivel plate 26 is shiftable between a irst position at which the assembly 30 is in operative elationship with the upper die assembly 24 and a position at which the lower die assembly 28 is in operative position with relation to the assembly 24.

Base 14 supports a spacer arm post 29 for pivotal movement between a first position in which a radially extending spacer arm 27 is operative in a manner to be described more fully hereinbelow and a second position in which the arm 27 is inoperative. Any suitable means such as a torsion spring (not shown) and a stop (not shown) may be employed normally to hold post 29 in one of its positions. A flange 33 on swivel plate 26 is adapted to engage a pin 31 on post 29 to move it to its other position in which arm 27 is operative. Spacer arm 27 is supported on post 29 for movement along the post between an upper and a lower position. An actuator 17 carried by ram 20 for movement therewith straddles post 29 to move arm 27 from its upper to its lower position. Since this structure and its operation are well known in the art, it will not be discussed in further detail.

Figure 2:
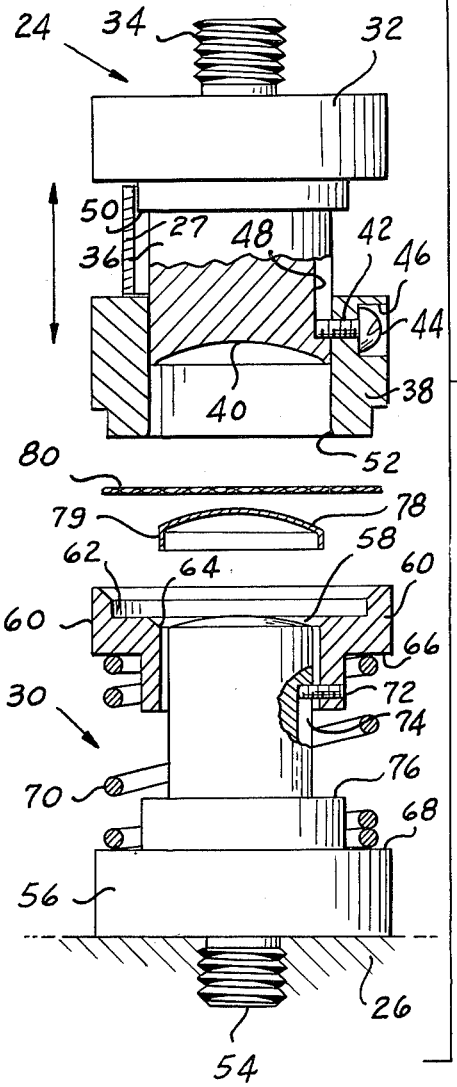
FIG. 2 is an elevation with parts in section of the pper die assembly of my improved apparatus in use /ith an assembly for inserting a covering piece and a ıell in the upper die assembly.

Referring now to FIG. 2, I have shown the upper half 24 in a position at which it is in operative relationship with the assembly 30. Upper die assembly 24 includes a collar 32 having a threaded stud 34 by means of which the collar 32 is assembled onto the rod 20. Collar 32 forms a part of the upper die assembly punch 36 which slidably receives a sleeve 38 which is adapted to move relative to a recess 40 in the face of the punch 36. A screw 42 having a head 44 received in a recess 46 in the outer surface of the sleeve 38 is adapted to ride in an axially extending groove 48 formed in the outer periphery of the punch 36. A shoulder 50 between the punch 36 and the collar 32 is adapted to be engaged by the sleeve 38 to limit upper movement of the sleeve with respect to the punch 36. I form the sleeve 38 with a mouth 52 through which a covering piece and shell are to be inserted in a manner to be described hereinbelow.

The covering piece and shell inserting assembly 30 includes a pedestal 56 formed with a threaded stud 54 adapted to be screwed into the swivel plate 26. Pedestal 56 forms a part of a post 58 which receives the lower sleeve 60 which is provided with an enlarged diameter covering piece locating bore portion 62 above the main bore portion to which it is connected by a shell guide 64. A spring 70 bears between a shoulder 66 on the sleeve 60 and a shoulder 68 on the pedestal 56 normally to urge sleeve 60 upwardly as viewed in FIG. 2. A screw 72 carried by the sleeve 60 rides in a slot 74 in the post 58 to guide the sleeve 60 for movement on the post. Under the action of the spring 70, screw 72 rides up into engagement with the upper end of the slot 74 to define the upper limit position of the sleeve 60 on the post 58. A shoulder 76 on pedestal 56 forms a lower limit stop for sleeve 60.

The structure thus far described and its operation are known in the art. In operation of the upper assembly 24 when in operative relationship with the assembly 30, a button shell 78 having a peripheral flange 79 is positioned in guide 64 of the lower assembly 30. Next, a blank 80 or piece of covering material is placed over the shell 78. In this position of the swivel plate 26 spacer arm 27 is disposed between collar 32 and the upper surface of sleeve 38 to prevent any appreciable relative movement between the parts as the covering piece 80 and shell 78 are inserted into sleeve 38. With the parts in this relative position, buttons 35 are simultaneously actuated to connect the upper end of cylinder 22 to source 23 and to connect the lower end of the cylinder to exhaust line 25 to drive ram 20 down to bring the upper assembly 24 downward on the assembly 30 to press sleeve 60 down against the action of the spring 70. As a result of this operation, the covering piece 80 and the shell 78 are forced upwardly into the sleeve 38 to the position illustrated in FIG. 3.

Figure 3:
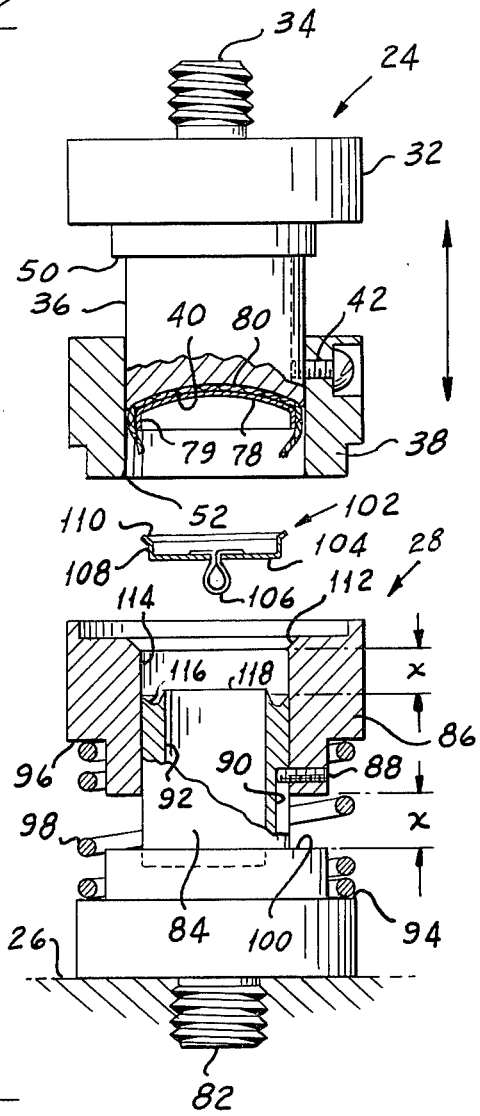
FIG. 3 is an elevation with parts in section of my nproved apparatus for assembling covered buttons ıowing the relative disposition of the two die assemlies at an intermediate point in the course of operation ıereof.

Referring now to FIG. 3 which shows the upper assembly 24 of my improved apparatus for assembling covered buttons in operative relationship with the lower assembly 28, lower assembly 28 includes a post 84 the base of which has a threaded stud 82, which permits the post to be screwed into the swivel plate 26. In this position of the swivel plate 26 arm 27 is inoperative.

Post 84 slideably supports a sleeve 86, the wall of which carries a screw 88, the inner end of which extends into a slot 90 extending axially in the outer surface of post 84 to support the sleeve 86 for sliding movement on the post 84. A spring 98 bearing between a shoulder 94 on the punch end and a shoulder 96 on the sleeve urges the sleeve upwardly to a limit position determined by the engagement of the inner end of screw 88 with the upper end of the slot 90. The down limit position of the sleeve 86 on the post 84 is defined by the engagement of the lower end of the sleeve with a shoulder 100 on the post 84.

One form of button back indicated generally by the reference character 102 in conjunction with which my improved apparatus has particular utility, is manufactured and sold by C & C Metal Products Corp. of Englewood, N.J., under the registered trademark "Lip-Lok." This back 102 includes a base 104 which supports a suitable fastening element, such for example as a wire eye 106. The upwardly extending peripheral flange 108 is formed with an outwardly extending lip 110 which facilitates the action of locking the back 102 to the shell 78.

I form the sleeve 86 with a first cam surface 112 which is adapted to cam the shell flange 79 inwardly with relation to base 104 in a manner to be described. Surface 112 leads into the generally cylindrical bore 114 of the sleeve 86 which rides on the post 84.

I form the upper end of my post 84 with a recess 116 providing a downwardly and inwardly directed second cam surface which, in the contracted relative positions of sleeve 86 and post 84 shown in FIG. 5, forms a smooth continuation of the surface 112. I provide an upwardly directed annular boss 118 at the upper end of the post bore 92 inwardly of the recess 116. I elevate the boss 118 to a level to allow the material and the lower edge of flange 79 of shell 78 to curl inwardly under base 104 if required.

With the assemblies 24 and 28 in the relative position shown in FIG. 3 and with sleeve 86 in its up position, a back 102 is placed on the boss 118 of the punch 84 in the position illustrated in broken lines in FIG. 5. Next, buttons 35 are again actuated to drive ram 20 down to bring the assembly 24 down toward the assembly 28. As this occurs, sleeve 38 engages sleeve 86 so that the former moves upwardly on the punch 36. Subsequently, the portion of the covering piece 80 under the edge of the flange 79 engages the beveled surface 112. Upon continued movement of the two assemblies relative to each other, sleeve 86 moves downwardly against the action of spring 98 until the bottom of the sleeve abuts the shoulder 100. When that occurs, further movement of the assembly 24 downwardly relative to assembly 28 causes the flange 79 to be bent inwardly toward the base 104 of the back 102. It is to be noted that the distance "x" between the inner end of the surface 112 and the upper edge of recess 116 is equal to the distance between the bottom of sleeve 86 and the shoulder 100. As a result as indicated in FIG. 5, when sleeve 86 bottoms on the shoulder 10 the surface of recess 116 forms a continuation of surface 112. Thus, upon further movement of the punch 36 downwardly, the flange 79 is bent further inwardly toward base 104 and ultimately may actually be bent slightly under the base 104.

The extent to which the flange 79 is bent inwardly relative to the wall 108 is determined by the thickness or weight of the covering material, as well as by the height of the shell flange 79 and the type of back used. Referring to FIG. 6, I have shown a relatively heavy covering material 120, such for example as leather or fabric-backed vinyl, or the like, in which the flange 79 is bent inwardly toward wall 108 sufficiently firmly to hold the covering material in place and to prevent the bottom assembly from popping apart. Referring to FIG. 7 where a relatively thin material 122, such as silk or the like is used for the covering material, flange 79 is bent inwardly to a greater extent than in the case of material 120 and may even be bent slightly under the base 104 of the back 102.

The operation of my improved apparatus for assembling covered buttons will readily be apparent from the description hereinabove. As has been pointed out hereinabove, it is not necessary that my apparatus be used with the "Lip-Lok" back, but may be used with any of the button backs known in the prior art. More specifically, my apparatus is not limited to use with backs having peripheral walls but may advantageously be used also with disk-like backs. Moreover, my apparatus is eminently suited to the use of other than circular buttons, such for example as buttons having a polygonal outline configuration. Further, it is not necessary that my apparatus be used with the swivel type assembling device as shown in FIG. 1. It could as well be used on a manually operated completely mechanical machine or on a completely automatic assembling machine, such as that shown and described in Chalfin and Peterson U.S. Pat. No. 3,442,163, issued May 6, 1969. No matter what assembly machine is employed or what backs and shells are used, my apparatus accommodates a much wider range of weights of covering material without changing dies than do die sets of the prior art.

It will be seen that I have accomplished the objects of my invention. I have provided an improved apparatus for assembling covered buttons. My apparatus does away with much of the need for changing dies for changes in weight of covering material for the same size of buttons. My apparatus greatly increases the efficiency of the operator.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. Apparatus for assembling a covered button made up of a shell having a peripheral flange and a piece of covering material and a back having a base, including in combination an upper punch and an upper sleeve carried by said upper punch for movement between a retracted position and an extended position, a lower die assembly comprising a lower post and a lower sleeve carried by said lower post for movement between an extended position and a retracted position, a first cam surface on the upper inner edge of said lower sleeve, a second cam surface extending around the periphery of said lower post, said second cam surface forming a continuation of said first cam surface in the retracted position of said position of said lower sleeve, button back base supporting means on said lower post extending above the lowest part of said second cam surface, and means for moving said upper and lower die assemblies toward each other.

2. In an apparatus for assembling a covered button made up of a shell having a peripheral flange and a piece of covering material extending over the shell and a back having a base, a button back receiving die assembly including a post having a longitudinal axis, a sleeve having a bore carried by said post for movement between a relatively retracted position and a relatively extended position, a first cam surface on said sleeve extending inwardly toward and inwardly along said axis at the inner edge of said sleeve, and a second cam surface on said post extending inwardly toward and inwardly along said axis from the periphery of said post, said second cam surface forming a continuation of the first cam surface in the retracted position of said sleeve on said post, and button back supporting means on said post located inwardly from said second cam surface toward said axis and extending outwardly of said second cam surface along said axis.

3. In an apparatus for assembling a covered button made up of a shell having a peripheral flange and a piece of covering material extending over the shell and a back having a base, a button back receiving die assembly including a post, a sleeve carried by said post for movement between a relatively retracted position and a relatively extended position, a first cam surface extending inwardly at the inner edge of said sleeve, and a second cam surface extending inwardly from the periphery of said post, said second cam surface forming a continuation of said first cam surface in the retracted position of said sleeve relative to said post and back elevating means on said post.

4. In an apparatus for assembling a covered button made up of a shell having a peripheral flange and a piece of covering material extending over the shell and a back having a base, a button back receiving die assembly including a post, a sleeve carried by said post for movement between a relatively retracted position and a relatively extended position, a first cam surface extending inwardly at the inner edge of said sleeve, and a second cam surface extending inwardly from the periphery of said post, said second cam surface forming a continuation of said first cam surface in the retracted position of said sleeve on said post.

* * * * *